US005592274A

United States Patent [19]

Higashi et al.

[11] Patent Number: 5,592,274

[45] Date of Patent: Jan. 7, 1997

[54] ELECTROPHOTOGRAPHIC APPARATUS AND PROCESS FOR SIMULTANEOUSLY TRANSFERRING AND FIXING TONER IMAGE ONTO TRANSFER PAPER

[75] Inventors: Taketoshi Higashi; Shigeru Yagi; Yuzuru Fukuda; Masato Ono; Masao Watanabe; Tsuyoshi Ohta, all of Kanagawa, Japan

[73] Assignee: Fuji Xerox Co., Ltd., Tokyo, Japan

[21] Appl. No.: 12,159

[22] Filed: Jan. 29, 1993

[30] Foreign Application Priority Data

Jan. 31, 1992 [JP] Japan ..... 4-040695
Jul. 21, 1992 [JP] Japan ..... 4-214797

[51] Int. Cl.[6] ..... G03G 15/14; G03G 15/20

[52] U.S. Cl. ..... 399/307; 430/97; 399/174

[58] Field of Search ..... 355/279, 277, 355/210, 200, 326 P, 326 M, 271, 290, 326 R; 430/66, 57, 58, 98, 99, 124, 126, 137, 138, 65, 67, 97

[56] References Cited

U.S. PATENT DOCUMENTS

| | | | |
|---|---|---|---|
| 3,811,765 | 5/1974 | Blake | 355/279 X |
| 4,319,828 | 3/1982 | Komori et al. | 355/210 |
| 4,365,549 | 12/1982 | Fotland et al. | 346/153.1 X |
| 4,477,549 | 10/1984 | Fujimaki et al. | 430/66 X |
| 4,607,936 | 8/1986 | Miyakawa et al. | 355/210 |
| 4,737,822 | 4/1988 | Taniguchi et al. | 355/326 P |
| 4,868,078 | 9/1989 | Sakai et al. | 430/58 X |
| 4,888,264 | 12/1989 | Matsumoto et al. | 430/137 |
| 4,965,154 | 10/1990 | Karakida et al. | 430/65 X |
| 5,057,875 | 10/1991 | Itoh | 355/279 X |
| 5,065,187 | 11/1991 | Itoh et al. | 355/219 X |
| 5,179,397 | 1/1993 | Ohzeki et al. | 355/271 |
| 5,198,842 | 3/1993 | Fujino et al. | 355/279 X |
| 5,204,202 | 4/1993 | Ishikawa et al. | 430/66 X |
| 5,241,359 | 8/1993 | Williams | 355/326 R |
| 5,323,185 | 6/1994 | Nagato et al. | 355/290 X |
| 5,334,476 | 8/1994 | Yagi et al. | 430/126 |

FOREIGN PATENT DOCUMENTS

| | | | |
|---|---|---|---|
| 55-87156A | 7/1980 | Japan . | |
| 56-150778A | 11/1981 | Japan . | |
| 57-179860A | 11/1982 | Japan . | |
| 58-66948A | 4/1983 | Japan . | |
| 58-173777 | 10/1983 | Japan | 355/277 |
| 59-148066A | 8/1984 | Japan . | |
| 59-162562A | 9/1984 | Japan . | |
| 62-242978 | 10/1987 | Japan | 355/279 |
| 63-149684 | 6/1988 | Japan . | |
| 1-43954B2 | 9/1989 | Japan . | |
| 3-033780 | 2/1991 | Japan | 355/271 |

*Primary Examiner*—Shuk Yin Lee
*Attorney, Agent, or Firm*—Finnegan, Henderson, Farabow, Garrett & Dunner, L.L.P.

[57] ABSTRACT

In an electrophotographic system, an electrostatic latent image as formed on a photoreceptor is developed with a developing agent to form a toner image thereon, a transfer paper is laid over the toner image and pressure is applied to the photoreceptor and the transfer paper so as to transfer or simultaneously transfer and fix the toner image onto the transfer paper. The photoreceptor is one having a surface protecting layer and a light-sensitive layer made of a hydrogenated and/or fluorinated amorphous silicon. The light-sensitive layer and the surface protecting layer of the photoreceptor are uniformly heated to a constant temperature. A charging device or a discharging brush or blade is used as a device of discharging the charges of the photoreceptor after the transference.

18 Claims, 3 Drawing Sheets

ELECTROPHOTOGRAPHIC APPARATUS AND PROCESS FOR SIMULTANEOUSLY TRANSFERRING AND FIXING TONER IMAGE ONTO TRANSFER PAPER

BACKGROUND OF THE INVENTION

The prsent invention relates to an electrophotographic apparatus and an electrophotographic process, using a photoreceptor having a photoconductive layer made of an amorphous silicon, and imparting pressure to a photoreceptor for conducting transference or simultaneous transference and fixation of a toner image onto a transfer paper.

For electrophotography, a so-called Carlson process of using a photoreceptor and comprising steps of electric charging, exposure, development, transference, cleaning and discharging has widely been employed. In accordance with the process, a toner image as developed is transferred to a transfer paper and then fixed thereon by a thermal roll system or pressure fixation system to obtain a final image.

As a transferring means in the process, generally used is a corotron. However, where the transference is effected with a corotron in the process, the toner being used would scatter during transference so that an image of high quality could hardly be obtained.

Simultaneous transference and fixation has been proposed for simplifying the process. As one example of using an amorphous silicon photoreceptor, JP-A 55-87156 (the term "JP-A" as used herein means an "unexamined published Japanese patent application") has proposed a method of simultaneous transference and fixation of a toner image onto a transfer paper with a hot fixing roller, using an amorphous silicon photoreceptor. In accordance with the method, however, since the surface of the roller is heated up to a high temperature of 180° C., continuous contact of the roller with the photoreceptor is impossible and a device of cooling the photoreceptor is necessary. Thus, the method involves some problems that it needs a complicated mechanisms and is unsuitable to continuous use. JP-A 1-43954 has proposed a method of simultaneous transference and fixation of using an electroconductive one-component toner under pressure. In accordance with the method of effecting simultaneous transference and fixation with imparting pressure to the photoreceptor, however, in case that the device of imparting pressure to the photoreceptor is directly kept in contact with the photoreceptor, that is, in case that a transfer paper is not between the photoreceptor and the device of imparting pressure to the photoreceptor, the toner would be transferred and fixed onto the device of imparting pressure to the photoreceptor when even a slight toner image has been formed on the photoreceptor. The troublesome phenomenon causes staining of the inner parts of the apparatus, clogging of transfer papers in the apparatus and staining of the back surface of the transferred papers and, as a result, it noticeably lowers the reliability of duplication operation by the method.

In order to improve the electrophotographic characteristics of an amorphous silicon photoreceptor, provision of a surface layer on the photoreceptor has been proposed. The surface layer is desired to be thicker so as to improve the mechanical strength thereof. In general, however, since the layer is made of an insulator, it would have a high residual potential when it is thick. As a result, the high residual potential would promote developability to often cause generation of fog. Because of the reason, the surface layer is generally designed to have a thickness of approximately from 0.1 to 1 μm and a residual potential of approximately from 0 to 50 volts.

SUMMARY OF THE INVENTION

One object of the present invention is to overcome the above-mentioned problems in the electrophotographic process for transferring or simultaneously transferring and fixing a toner image as formed on a photoreceptor onto a transfer paper by imparting pressure to the photoreceptor and to provide a novel energy-saving and cost-saving high-reliability electrophotographic process and an apparatus capable of forming a transferred image without problems of staining of the inner parts of the apparatus used, clogging of transfer papers in the apparatus and staining of the back surface of the transferred papers.

Another object of the present invention is to provide an electrophotographic process of using a long-life and high-reliability amorphous silicon photoreceptor.

The present invention provides an electrophotographic process where an electrostatic latent image as formed on a photoreceptor is developed with a developing agent to form a toner image thereon, a transfer paper is laid over the toner image and pressure is applied to the photoreceptor and the transfer paper so as to transfer or simultaneously transfer and fix the toner image onto the transfer paper; the process being characterized in that the photoreceptor is one having a light-sensitive layer made of a hydrogenated and/or fluorinated amorphous silicon and that a charging device or a discharging brush or blade is used as a means of discharging the charges of the photoreceptor after the transference.

The electrophotographic apparatus of the present invention is composed of a photoreceptor made of a hydrogenated and/or fluorinated amorphous silicon, a charging device, an exposing device, a developing device and a transferring fixing device, in which a transfer paper is laid over a toner image on the surface of the photoreceptor as formed thereon by electrophotography and pressure is applied to the photoreceptor and the transfer paper for conducting simultaneous transference and fixation of the toner image onto the transfer paper; and it is characterized in that the transferring fixing device is equipped with a transferring part as disposed to face to the photoreceptor to press it and a cleaning mechanism of being kept in contact with the surface of the transferring part.

BRIEF DESCRIPTION OF THE INVENTION

FIG. 1 is a constitutional outline view of showing one embodiment of the electrophotographic apparatus to be used in carrying out the method of the present invention, FIG. 2 is a graphical sectional view of showing one example of the photoreceptor to be used in carrying out the method of the present invention, and FIG. 3 is a graphical sectional view of showing another example of the photoreceptor.

FIG. 4(*b*) is a fragmentary cross-section showing an embodiment of the invention where an irradiating light is applied to the photoreceptor to remove charges therefrom.

FIG. 4(*c*) is a fragmentary cross-section showing an embodiment of the invention where the cleaning mechanism is a cleaning roll.

FIG. 5(*b*) is a schematic drawing of a dicorotron.

DETAILED DESCRIPTION OF THE INVENTION

The present invention will be described hereunder, with reference to the drawings attached hereto.

Figure 1:
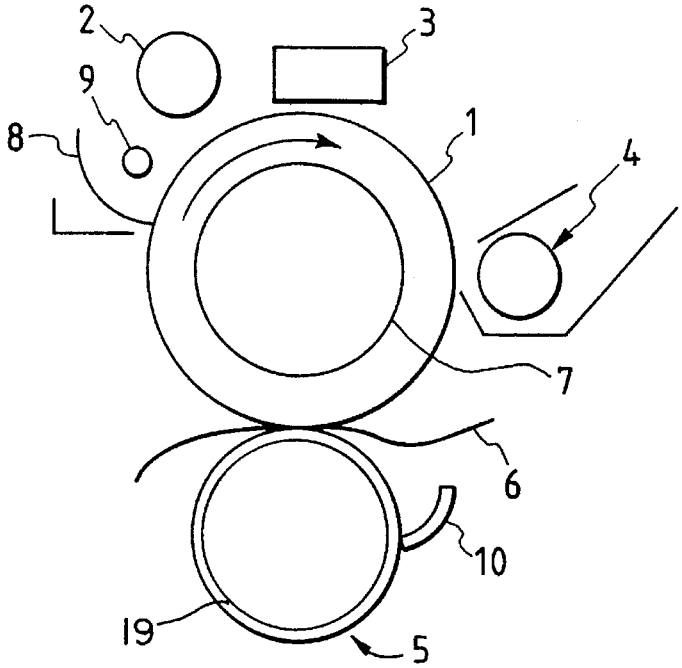

FIG. 1 is a graphical constitutional view of showing one embodiment of an electrophotographic apparatus to be used for carrying out the electrophotographic process of the present invention. In FIG. 1, the surface of a photoreceptor 1 is electrically charged by a charging device 2 and is thereafter exposed to light from an image. inputting device 3, such as an original image as passed through an external optical system, or a laser or LED, whereby an electrostatic latent image is formed on the surface. Then, the latent image is converted into a visible image by a developing device 4. The thus formed visible image is transferred or is simultaneously transferred and fixed onto a transfer paper 6 by a transferring pressure roll 5. A heater 7 is disposed in the inside of the photoreceptor, with which the temperature of the surface of the photoreceptor is controlled to be always constant. The toner as remained on the photoreceptor is removed by a cleaning mechanism 8, and the charges as remained on the surface of the photoreceptor are removed by a discharging device 9. A cleaning device 10 may be provided in the apparatus for the purpose of cleaning the transferring pressure roll.

Figure 2:
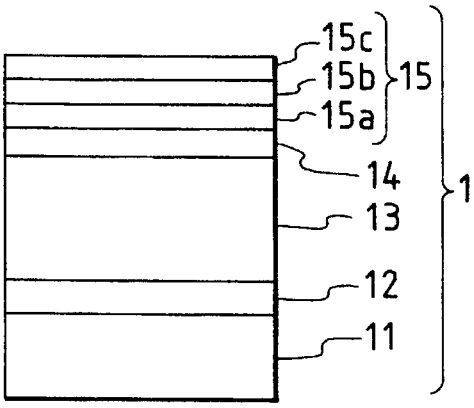

First, the photoreceptor 1 as shown in FIG. 2 will be explained. The photoreceptor to be used in the present invention is an amorphous silicon photoreceptor, which has a support 11. The support 11 may be made of anyone of aluminium, iron, stainless steel and various alloys of metals including the preceding metals, as well as electroconductivity-imparted glass, polycarbonates and acrylic resins. The thickness of the support is suitably selected in accordance with the hardness thereof durable to the transferring or transferring-fixing pressure to be applied thereto. In general, it is desirably within the range of from 1 mm to 30 mm.

On the support 11 provided are a charge penetration inhibiting layer 12, a photoconductive layer 13 and an electron trapping layer 14. The respective layers consist essentially of a hydrogenated and/or fluorinated amorphous silicon and may be formed by various means of, for example, glow-discharing decomposition, sputtering, ion-plating or vacuum vapor deposition. The case of forming the layers by glow-discharging decomposition will be explained hereunder as one example. As a raw material gas, used is a mixed gas comprising an essential gas component containing silicon atom and additional gas component(s) containing additional necessary atom(s). If desired, the mixed gas may further contain a carrier gas such as a hydrogen gas or an inert gas. Regarding the filming conditions, the frequency is from 0 to 5 GHz, the inner pressure in the reactor is from $10^{-5}$ to 10 Torr (0.001 to 1330 Pa), the discharging power is from 10 to 3000 W and the support temperature is from 30° to 300° C. The thickness of each layer may suitably be determined by adjusting the discharging time. As the essential gas component containing silicon atom are, for example, silanes, especially $SiH_4$ and/or $Si_2H_6$.

The charge penetration inhibiting layer 12 is made of an amorphous silicon to which a Group III element or Group V element has been added. The thickness of it is desirably within the range of from 0.01 to 10 μm. The additive of a Group III element or Group V element is determined in accordance with the charging polarity of the photoreceptor. In forming the layer, the raw material gas containing a Group III element to be used is typically diborane ($B_2H_6$), and the raw material gas containing a Group V element to be used is typically phosphine ($PH_3$). If desired, the charge penetration inhibiting layer consisting essentially of an amorphous silicon may contain any other elements for various purposes, in addition to the Group III element and Group V element.

The photoconductive layer 13 is made of a hydrogenated and/or fluorinated amorphous silicon. Where the photoconductive layer is made of a fluorinated amorphous silicon, for example, $SiF_4$, $Si_2F_6$, $SiHF_3$, $SiH_2F_2$ and the like are used along with the silanes.

Addition of a Group III element to the photoconductive layer is preferred. As a raw material gas containing a Group III element, typically used is diborane. The photoconductive layer consisting essentially of an amorphous silicon may contain, if desired, any other various elements for various purposes in addition to the Group III element. The thickness of the layer is desirably within the range of from 1 to 100 μm. The photoconductive layer may optionally be composed of two layers of a charge generating layer and a charge transporting layer.

The electron trapping layer 14 is made of an amorphous silicon to which a Group III element or Group V element has been added. The thickness of it is desirably within the range of from 0.01 to 10 μm. Determination of the additive of a Group III element or Group V element is made in accordance with the charging polarity of the photoreceptor. As the raw material gas of containing a Group III element to be used in forming the layer, typically mentioned is diborane. As the raw material gas of containing a Group V element to be used, typically mentioned is phosphine. The electron trapping layer consisting essentially of an amorphous silicon may optionally contain any other elements for various purposes, in addition to the Group III element and Group V element.

The surface layer 15 may have either a single layer constitution or a multi-layer constitution (comprising layers 15*a*, 15*b* and 15*c*).

The surface layers 15*a*, 15*b* and 15*c* each may consist essentially of an amorphous silicon to which nitrogen atom has been added. The nitrogen atom-containing raw material gas to be used for forming the layers may be any and every simple substance or compound which has nitrogen atom as the constitutive element and which may be used as a gaseous phase. As examples, mentioned are $N_2$ simple gas and vapors of nitrogen hydride compounds such as $NH_3$, $N_2H_4$ and $HN_3$. The nitrogen atom-containing raw material gas to be formed for forming the respective surface layers may be same or different. The respective surface layers may optionally contain any other elements for various purposes.

The nitrogen atom concentration in the first surface layer 15*a* is desirably within the range of from 0.1 to 1.0 as an atomic ratio to the silicon atom therein. The thickness of the layer 15*a* is desirably within the range of from 0.01 to 0.1 μm.

The nitrogen atom concentration in the second surface layer 15*b* is desirably within the range of from 0.1 to 1.0 as an atomic ratio to the silicon atom therein. The thickness of the layer 15*b* is desirably within the range of from 0.05 to 1 μm.

The nitrogen atom concentration in the third surface layer 15*c* is desirably within the range of from 0.5 to 1.3 as an atomic ratio to the silicon atom therein. The thickness of the layer 15*c* is desirably within the range of from 0.01 to 0.1 μm.

These surface layers may consist essentially of an amorphous silicon to which carbon atom or oxygen atom has been added.

Figure 3:
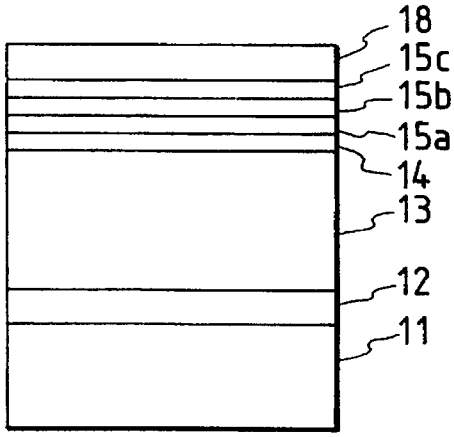

In FIG. 3, the fourth surface layer 18 is provided over the preceding surface layers. The fourth surface layer has a function of preventing the surface of the amorphous silicon photoreceptor from being scratched during fixation under pressure or of improving the transferring efficiency.

Further, as examples of the materials of forming the surface layer, mentioned are SiOx, SiNx, SiCx, a-C, AlOx, as well as organic high polymer materials or inorganic high polymer materials containing a fine powder of an electroconductive metal oxide as dispersed therein. The layer may be formed, using any of the materials, by a plasma CVD method, a vapor deposition method or an ion plating method. Also usable are an inorganic filming material of a silicon hard coating material and a thermosetting organic high polymer material of epoxy resins or urethane resins, from which the layer is formed by a solvent cast method. These materials may be used singly or in combination of two or more of them. The surface layer is desired to be thick so as to prevent reduction of the life of the photoreceptor due to abrasion or scratches to be caused by troubles. The surface layer is effective for preventing scratches to be formed on the surface of the amorphous silicon photoreceptor during fixation under pressure and for improving the transferring efficiency.

When the surface layer is made of a dispersion of a fine powder of an electroconductive metal oxide as dispersed in a binder resin, the fine powder is desired to have a mean grain size of 1 μm or less, especially preferably of falling within the range of from 0.05 to 0.3 μm. As the fine powder of an electroconductive metal oxide, usable is, for example, a fine powder of zinc oxide, tin oxide, antimony oxide, indium oxide, bismuth oxide, tin-doped indium oxide, antimony-doped tin oxide or zirconium oxide. One or more of such fine metal oxide powders may be used singly or in combination. If two or more of them are used in combination, they may be used in the form of a solid solution or fused body of them.

The binder resin is an organic high polymer material, which includes, for example, polyvinyl carbazole, acrylic resins, polycarbonate resins, polyester resins, epoxy resins, unsaturated polyester resins, polyamide resins, and polyimide resins. Of them, preferred are hardenable resins in view of the mechanical strength and the adhesiveness.

When such an organic high polymer material is used as a binder resin, a solution or dispersion containing the material as dissolved or dispersed therein is prepared and coated, after the viscosity thereof has been adjusted, over the light-sensitive layer or interlayer by spray-coating or dip-coating and thereafter dried or hardened with drying to form the surface layer thereon.

The surface layer may optionally contain other various additives for the purpose of improving the adhesiveness and the smoothness.

As usable inorganic high polymer materials, mentioned are, for example, silicone resins and inorganic high polymer compounds made of organic metal compounds.

When a liquid silicone resin is used as the inorganic high polymer material, for example, a fine powder of the electroconductive metal compound may be dispersed thereinto and the resulting dispersion may be coated and dried over the light-sensitive layer or interlayer.

The layer may also be formed by a sol-gel method, which is, for example, as follows: An alkoxide compound such as $Si(OCH_3)_4$, $Si(OC_2H_5)_4$, $Si(OC_3H_7)_4$, $Si(OC_4H_9)_4$, $Al(OCH_3)_3$, $Al(OC_2H_5)_3$, $Al(OC_3H_7)_3$, $Al(OC_4H_9)_3$, $Ti(OC_3H_7)_4$, $Zr(OC_3H_7)_4$, $Y(OC_3H_7)_3$, $Y(OC_4H_9)_3$, $Fe(OC_2H_5)_3$, $Fe(OC_3H_7)_3$, $Fe(OC_4H_9)_3$, $Nb(OCH_3)_5$, $Nb(OC_2H_5)$ 5, $Nb(OC_3H_7)_5$, $Ta(OC_3H_7)_5$, $Ta(OC_4H_9)_4$, $Ti(OC_3H_7)_4$, $V(OC_2H_5)_3$ or $V(OC_4H_9)_3$, or an organic metal complex such as iron tris(acetyl acetonate), cobalt his(acetyl acetonate), nickel his (acetyl acetonate) or copper bis(acetyl acetonate) is dissolved in an alcohol and hydrolyzed with stirring. A fine powder of the preceding electroconductive metal oxide is dispersed into the sol liquid as formed by the reaction, and the resulting dispersion is coated over the photoconductive layer or interlayer by spray-coating or dip-coating and heated and dried at 50° to 300° C. for 1 to 24 hours after the solvent has been removed therefrom.

The thickness of the surface layer may be determined freely, and it is preferably 0.1 μm or more and 20 μm or less, more preferably 0.5 μm or more and 10 μm or less. If it is less than 0.1 μm, the mechanical strength would be poor. If it is larger than 20 μm, a residual potential after light exposure is high. Thus, the characteristics of the amorphous silicon photoreceptor would be retarded.

The photoreceptor may be heated at 30° to 80° C. for the purpose of stabilizing the electrophotographic characteristics and the charging potential. When the temperature is kept constant for the purpose of stabilizing the charging potential, it is difficult to keep the temperature at 30° C. or lower as the temperature is apt to fluctuate due to the ambient atmosphere. If the temperature is higher than 80° C., the dark. resistance of the amorphous silicon photoreceptor would lower so that the photoreceptor could hardly have the static potential necessary for development.

In FIG. 1, heating of the photoreceptor is effected only from the inside of the photoreceptor. However, the heating may also be effected from the outside of it.

As the heating means, usable are, for example, a lamp heater (quartz lamp) and a heater having nichrome wires as disposed in a heat-resistant elastic rubber such as a silicone rubber. In addition, also usable are a hot air heater, a heater of generating a radiant heat from infrared rays, and a heater of transferring the heat from the fixing part. As a means of applying electricity to the heating means of the photoreceptor, anyone may be used. Especially when the heating means is disposed in the inside of the support of the photoreceptor, a charging means of the kind that applies electricity to the photoreceptor via a slipping means is desired, since the photoreceptor is rotated during operation.

To the developing device 4 may be applied a bias potential. The potential to be applied to the developing device varies, depending upon the image inputting method, the image forming method and the developing agent to be used. For instance, when an image writing method is employed for inputting images and an electroconductive toner is used as a developing agent, the potential to be applied to the developing device for developing the exposed (image) area is desired to be the same potential as the charging potential at the development position of the photoreceptor; and when the non-exposed area is developed by the same method, the potential to be applied to the developing device is desired to be 0 V or to be the same potential (residual potential of the photoreceptor: RP) as that of the exposed area. When a back writing method is employed for inputting images and an electroconductive toner is used as a developing agent, the potential to be applied to the developing device is desired to be 0 V or to be the same potential as that of the exposed area for development of the non-exposed area; and when the exposed area is developed by the same method, the potential to be applied to the developing device is desired to be the same potential as the charging potential at the development position of the photoreceptor.

The transferring pressure roll to be used in the present invention is desired to have a high mechanical strength so as to prevent deformation of itself due to damages to be caused by troubles of the photoreceptor and the transfer papers including clogging of them in the apparatus. The pressure for transference or for simultaneous transference and fixation varies, depending upon the developing agent used. For instance, when a developing agent for simultaneous transference and fixation is used, the pressure is 100 kg weight/$cm^2$ or more, preferably 150 kg weight/$cm^2$ or more, more preferably 200 kg weight/$cm^2$ or more.

The surface of the transferring pressure roll is desired to be coated with a surface protecting layer 19, as shown in FIG. 1. Due to the surface protecting layer, surface abrasion of the pressure transferring device during cleaning may be reduced and the damage to be generated during transference under pressure may also be reduced. As a result, the reliability of the transferring pressure roll may be elevated. The surface protecting layer may be made of at least one selected from the group consisting of ceramics, metals, organic high polymer substances and inorganic high polymer substances. Selection of one having a small surface energy is desired for forming the surface protecting layer, in order that the toner as adhered to the transferring pressure roll may easily be removed by cleaning.

As specific examples of the materials of constituting the surface protecting layer, mentioned are ceramics such as C, Si, a-C, a-Si, SiOx, SiNx, SiCx and AlOx; metals and alloys such as Fe, Ni, Cr, Al Cu, copper brass and stainless steel; organic polymers of thermoplastic or thermosetting resins such as polycarbonates, polyesters, polymethacrylates polysulfones, polyacrylates, polyimides, polyamides polyurethanes, polystyrenes, polyaryl ethers, polyaryl sulfones, polybutadienes, polyether sulfones polyethylenes, polypropylenes, polymethylpentenes polyphenylene sulfides, polyvinyl acetates, polysiloxanes polyvinyl acetals, amino resins, phenyleneoxide resins, terephthalic acid resins, epoxy resins, phenolic resins, polystyrene-acrylonitrile copolymers, polyvinyl chlorides, vinyl chloride-vinyl acetate copolymers, acrylate copolymers, alkyd resins, epoxides, cellulose filming agents, poly(amido-imides), polychlorostyrenes, poly (α-methylstyrenes), polyvinyl naphthalenes, polyvinyl ethers, polyvinyl alcohols, polyvinyl butyrals, polyvinyl formals, polyvinyl carbazoles, polyvinyl pyridines, polyvinylidene chlorides, polyvinylidene fluorides, vinylidene chloride-vinyl chloride copolymers, styrene-butadiene copolymers, vinyl acetate-vinylidene chloride copolymers and styrene-alkyd resins; and inorganic high polymers such as silicone resins and those formed from organic metal compounds. The materials are coated over the surface of the roll by, for example, glow-discharging decomposition, sputtering, ion plating or vacuum vapor deposition.

Figure 4A:
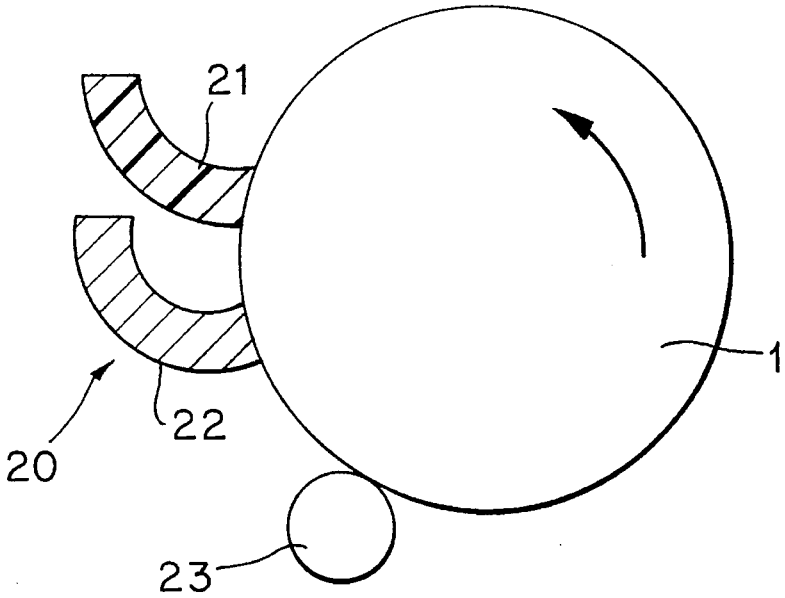
FIG. 4(*a*) is a fragmentary cross-section of an embodiment of the invention where the cleaning mechanism is an elastic blade and a metal blade.
Figure 4B:
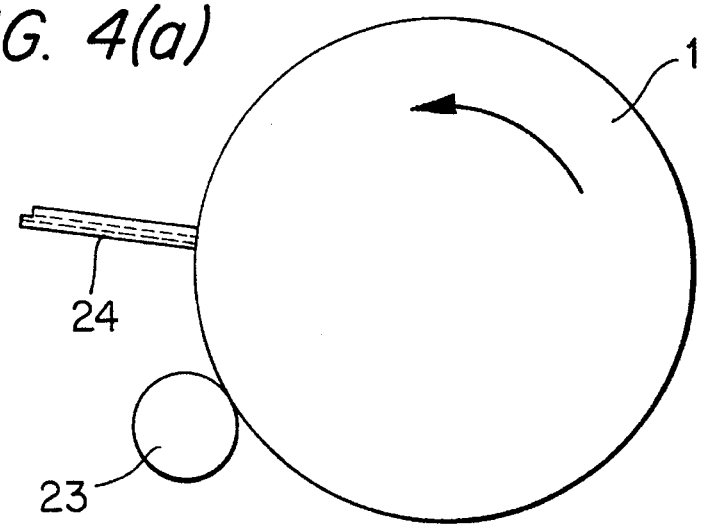
Figure 4C:
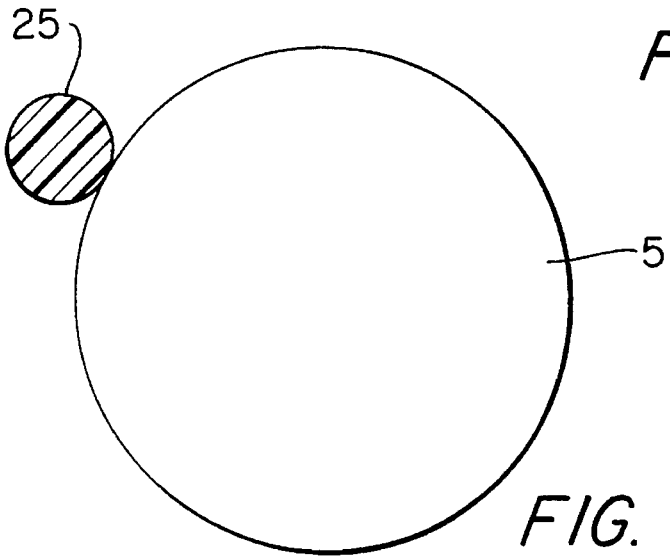

As one embodiment of the present invention, the cleaning mechanism 20 may be disposed to be kept in contact with the surface of the transferring part. The cleaning mechanism is desired to be composed of at least one of a metal blade made of, for example, Fe, Ni, Cr, Al, Cu, copper, brass or stainless steel, and an elastic blade, roll, fabric wiper or brush made of, for example, an urethane rubber or the like. In FIG. 1, a cleaning blade is used as the cleaning mechanism and it is kept in contact with the surface of the pressure transferring roll. FIG. 4(*a*) shows an embodiment where both a metal blade 22 and an elastic blade 21 are used, and FIG. 4(*c*) shows an embodiment where an elastic cleaning roll 25 is used.

Figure 5A:
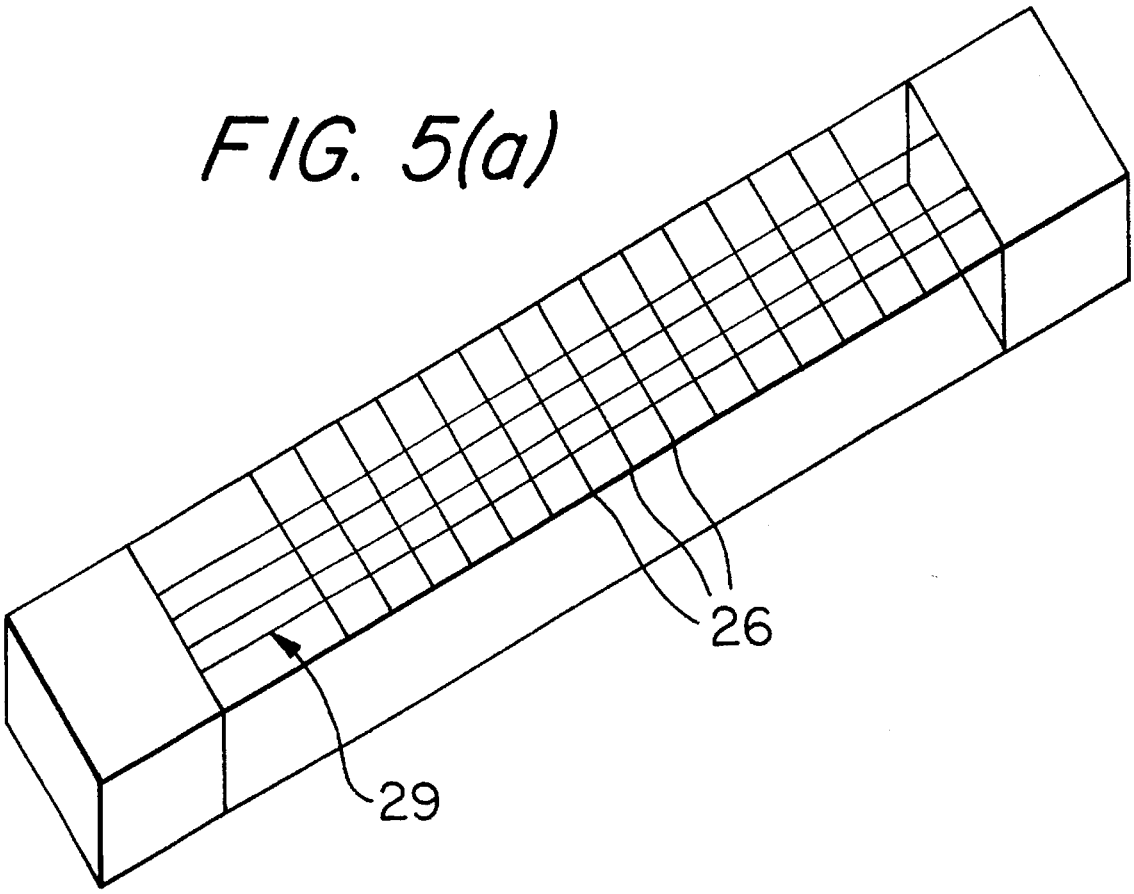
FIG. 5(*a*) is a schematic drawing of a scorotron.
Figure 5B:
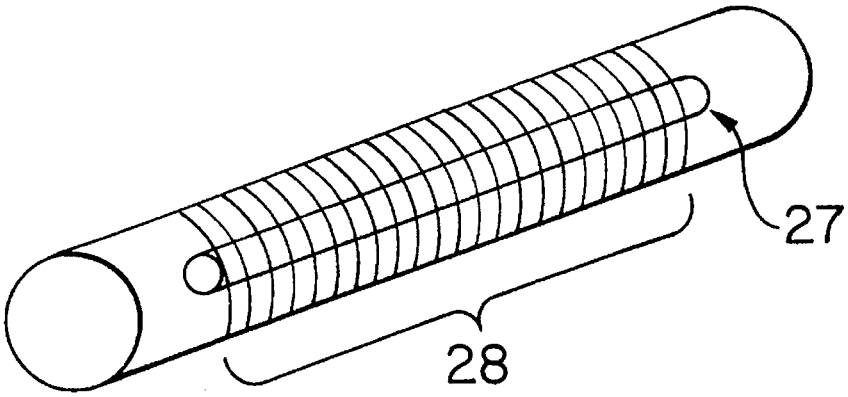

In the present invention, at least an electric charger, or a discharging brush or blade must be used as the discharging device 9 in FIG. 1, and discharging device 23 in FIGS. 4(*a*) and 4(*b*). For instance, the charges as remained on the surface of the photoreceptor may be removed with a scorotron, dicorotron, charging roll or discharging brush. If desired, after the charges are previously removed with light 24 as applied to the photoreceptor in FIG. 4(*b*) and thereafter the still remaining charges may be removed with a charger such as corotron, or with a discharging brush or blade. The corotron is a kind of charging device in which a thin tungsten wire (29 in FIG. 5(*a*)) is extended between two terminals. Three sides thereof are covered with insulation shields and one side thereof is an opening portion. A d.c. current or an a.c. voltage is applied to the tungsten wire to cause corona discharge. An ion flow generated by the corona discharge is released from the opening portion so that the surface of a sensitive material opposite to the opening portion of the corotron is charged to a predetermined potential. In the scorotron as shown in FIG. 5(*a*), a plurality of wires 26 are extended to the opening portion of the corotron and a d.c. bias voltage is applied to the wires. The dicorotron as shown in FIG. 5(*b*), is composed of two corotron wires 27 and 28 arranged in parallel.

Since discharging with only light to be applied to the charged photoreceptor could not completely remove the charges as remained on the surface of the photoreceptor, the thickness of the surface layer of the photoreceptor could not be large and therefore the mechanical strength of the photoreceptor is insufficient. As a result, the surface of the photoreceptor would often be worn or scratched due to accidents so that the life of the photoreceptor could not be prolonged well. In particular, when a developing agent or a developing system to be used or operated at a low potential is used, the charges as remained on the surface of the photoreceptor would act for development. In addition, when the potential of the surface of the photoreceptor fluctuates due to fluctuation of the number of the charging times, the photoreceptor would have still another drawback that it could hardly has a stable charging potential.

In the present invention, a capsule toner may be used as a developing agent. When a capsule toner is used, simultaneous transference and fixation may be effected by the use of the pressure transferring device. As a result, the total apparatus may be small-sized and the energy to be applied to the apparatus may be saved, favorably.

The capsule toner usable in the present invention comprises a core material and a shell material.

As the core material, preferred is one comprising a binder resin, a high boiling solvent of solving the resin and a colorant, or one essentially comprising a soft solid substance and a colorant. If desired, additives such as silicone oil and the like may be added thereto for the purpose of improving the fixing capacity. If desired, a high boiling point solvent not dissolving the binder resin may also be added to the high boiling point solvent of dissolving the resin.

As the binder resin, usable is any known fixing resin. Specifically, it includes, for example, acrylic ester polymers such as polymethyl acrylate, polyethyl acrylate, polybutyl acrylate, poly-2-ethylhexyl acrylate and polylauryl acrylate; methacrylic ester polymers such as polymethyl methacrylate, polybutyl methacrylate, polyhexyl methacrylate, poly-2-ethylhexyl methacrylate and polylauryl methacrylate; copolymers of a styrenic monomer and an acrylic ester or methacrylic ester; ethylenic polymers such as polyvinyl acetate, polyvinyl propionate, polyvinyl butyrate, polyethylene and polypropylene and copolymers of them; styrenic copolymers such as styrene-butadiene copolymer and styrene-maleic acid copolymer; and polyvinyl ethers, polyvinyl ketones, polyesters, polyamides, polyurethanes, rubbers, epoxy resins, polvinyl butyrals, rosins, modified rosins, terpene resins and phenolic resins. These resins may be used singly or in combination of two or more of them. If desired, monomers of constituting the polymer may be used as they are and are polymerized after encapsulation to make the intended binder resin in the capsule.

As the high boiling point solvent of dissolving the binder resin, usable is an oily solvent having a boiling point of 140° C. or higher, preferably 160° C. or higher. Specifically, the solvent includes, for example, phthalic esters (e.g., diethyl phthalate, dibutyl phthalate); aliphatic dicarboxylic esters (e.g., diethyl malonate, dimethyl oxalate); phosphate esters (e.g., tricresyl phosphate, trixylyl phosphate); citrate esters (e.g., o-acetyltriethyl citrate); benzoate esters (e.g., butyl benzoate, hexyl benzoate); fatty acid esters (e.g., hexadecyl myristate, dioctyl adipate); alkylnaphthalenes (e.g., methylnaphthalene, dimethylnaphthalene, monoisopropylnaphthalene, diisopropylnaphthalene ); alkyl diphenyl ethers (e.g., o-, m-, p-methyl diphenyl ether); higher fatty acid or aromatic sulfonic acid amide compounds (e.g., N,N-dimethyllauroamide, N-butylbenzenesulfonamide); trimellitates (e.g., trioctyl trimellitate); diarylalkanes (e.g., diarylmethanes such as dimethylphenylmethane, and diarylethanes such as 1-phenyl-1-methylphenylethane, 1-dimethylphenyl-1-phenylethane, 1-ethylphenyl-1-phenylethane); and chlorinated paraffins.

As examples of the colorant, mentioned are inorganic pigments such as carbon black, red iron oxide, prussian blue and titanium oxide; azo dyes such as fast yellow, disazo yellow, pyrazolone red, chelate red, brilliant carmine and parabrown; phthalocyanines such as copper phthalocyanine and metal-free phthalocyanine; and condensed polycyclic pigments such as flavanthorone yellow, dibromoanthrone orange, perylene red, quinacridone red and dioxane violet. In addition to them, disperse dyes and oil-soluble dyes may also be used.

When an electroconductive one-component toner is used as the capsule toner in the present invention, all or a part of the black colorant in it may be substituted by a magnetic powder. As the magnetic powder, for example, usable is a powder of magnetite, ferrite or a simple metal of cobalt, iron or nickel, or an alloy of them. The magnetic powder may be a modified one to be prepared by surface-treating it with a coupling agent such as a silane coupling agent or a titanate coupling agent or with an oil-soluble surfactant or one to be prepared by surface-coating it with an acrylic resin, styrene resin or epoxy resin.

The soft solid substance to constitute the capsule toner for use in the present invention may be anyone which is soft and flexible at room temperature and which has a fixing capacity, and the kind of it is not limitative. Preferred is a polymer having a Tg point of falling within the range of from −60° C. to 5° C.

Additives such as silicon oxide, aluminium oxide, titanium oxide or carbon black may be added to the capsule toner, so as to make it fluid and electrically chargeable. For adding them to the capsule toner, for example, the dried capsule toner may be dry-blended with the additive with a dry mixer such as a V blender or Henschel mixer so that the additive is stuck to the surface of the capsule toner, or alternatively, the additive is first dispersed in an aqueous liquid such as water or a mixed water/alcohol and is then added to a slurry capsule toner so that the additive is stuck to the surface of the capsule toner.

The shell material of constituting the capsule toner is preferably selected from polyurea resins, polyurethane resins, polyamide resins, polyester resins, epoxy resins, epoxyurea resins and epoxyurethane resins.

The method of encapsulation for preparing the capsule toner is not specifically defined. In consideration of the safety of the shell and the mechanical strength of the same, encapsulation by interfacial polymerization is recommended. For encapsulation by interfacial polymerization to prepare the capsule toner, any known method may be employed. (For instance, see JP-A 57-179860, 58-66948, 59-148066 and 59-162562.)

For incorporating the preceding polymer into the inside of each capsule as one component of the core material, a method may be employed in which the polymer is previously prepared and is blended with the other core-forming components along with a low boiling point solvent and shell-forming components, the shell is formed by interfacial polymerization, and, along with or after the formation of the shell, the low boiling point solvent is removed out of the polymerization system and the core is then formed under the condition.

The grain size of the capsule toner for use in the present invention is desirably within the range of from 5 μm to 25 μm as a volume average grain size.

In the present invention, an electroconductive toner may be used as the developing agent. When an electroconductive toner is used in a transferring method, in general, the method is needed to be somewhat modified. The pressure transferring system of the present invention is effective as one transferring means of using an electroconductive toner. The transferring efficiency in the method of the invention of using an electroconductive toner is 90% or more, which is extremely higher than that of any other transferring system. Thus, use of an electroconductive toner in the method of the present invention is preferred from the viewpoint of energy-saving. When an electroconductive magnetic one-component toner is used in the method of the invention, rapid and low-potential development is possible. This is favorable in view of the characteristics of the amorphous silicon photoreceptor to be used in the method of the invention. The toner is more preferably in the form of a capsule toner, since simultaneous transference and fixation is possible with it.

The operation of the present invention will be explained, referring to one example of carrying out copying operation with the electrophotographic photoreceptor of FIG. 1. The surface of the photoreceptor 1 is uniformly electrically charged with the charging device 2, then an electrostatic latent image is formed by exposure with the light from the image inputting device 3, and the latent image is converted into a visible image comprising a toner with the developing device 4. The thus formed visible image is then brought into contact with the transfer paper 6 by the transferring pressure roll 5 under pressure, whereupon transference or simultaneous transference and fixation of the toner image onto the transfer paper is conducted. The charges as remained on the photoreceptor are completely removed by the discharging device 9. Accordingly, using the electrophotographic apparatus of the present invention, copy images of high quality may be obtained.

Since an electric charger or a discharging brush or blade is used as the discharging device in the method of the present invention, the invention has additional advantages mentioned below. Specifically, the charges as remained on the surface of the photoreceptor may be removed completely, and the thickness of the surface layer of the photoreceptor may be enlarged. As a result, the photoreceptor is hardly worn or scratched due to accidents, and the life of the photoreceptor may be noticeably prolonged. In addition, since the photoreceptor has a high mechanical strength, a metal blade may be used as the cleaning blade, which is effective for preventing filming or generation of comets. Further, the life of the cleaning system of itself is much longer than that of using a rubber blade. After discharged, since no charge remains on the surface of the photoreceptor, adhesion of a developing agent to the pressure transferring device in electrophotography to be conducted under pressure may be prevented. Moreover, even when the potential of the surface of the photoreceptor fluctuates due to fluctuation of the number of the charging times, the charging potential may well be stabilized as still another advantage of the invention.

In addition, since the transferring system of the present invention is conducted under pressure, the developing agent being used does not scatter during discharging for transference so that images of high image quality may easily be obtained. As further advantage of the invention, the present invention may well employ an electroconductive developing agent which could not be used in a static transferring system.

Next, the present invention will be explained in more detail by way of the following examples, which, however, are not limitative.

EXAMPLE 1

An amorphous silicon photoreceptor mentioned below was set to the electrophotographic apparatus of FIG. 1. The conditions of forming the amorphous silicon photoreceptor were as follows:

A charge penetration inhibiting layer, a photoconductive layer, an electron trapping layer and first to third surface layer were formed in order on an Al—Mg alloy cylindrical support having a thickness of about 20 mm. The filming conditions for the respective layers were as follows:

The charge penetration inhibiting layer was formed under the following conditions:

100% silane gas flow rate: 180 $cm^3$/min
100% hydrogen gas flow rate: 90 $cm^3$/min
200 ppm hydrogen-diluted diborane gas flow rate: 90 $cm^3$/min
Inner pressure of reactor: 1.0 Torr
Discharging power: 200 W
Discharging time: 60 min
Discharging frequency: 13.56 MHz
Support temperature: 250° C.

(The discharging frequency and the support temperature in the filming conditions of forming the following layers were fixed to be those mentioned above.)

After formation of the charge penetration inhibiting layer, the inside of the reactor was sufficiently purged, and a mixture comprising silane gas, hydrogen gas and diborane gas was introduced thereinto for carrying out glow-discharging decomposition to thereby form a photoconductive layer having a thickness of about 15 μm over the charge penetration inhibiting layer. The filming conditions were as follows:

100% silane gas flow rate: 180 $cm^3$/min
100% hydrogen gas flow rate: 162 $cm^3$/min
200 ppm hydrogen-diluted diborane gas flow rate: 18 $cm^3$/min
Inner pressure of reactor: 1.0 Torr
Discharging power: 200 W
Discharging time: 210 min After formation of the photoconductive layer, the inside of the reactor was sufficiently purged, and a mixture comprising silane gas, hydrogen gas and diborane gas was introduced thereinto for carrying out glow-discharging decomposition to thereby form an electron trapping layer having a thickness of about 0.9 μm over the photoconductive layer. The filming conditions were as follows:

100% silane gas flow rate: 180 $cm^3$/min
100% hydrogen gas flow rate: 90 $cm^3$/min
200 ppm hydrogen-diluted diborane gas flow rate: 90 $cm^3$/min
Inner pressure of reactor: 1.0 Torr
Discharging power: 200 W
Discharging time: 12 min After formation of the electron trapping layer, the inside of the reactor was sufficiently purged, and a mixture comprising silane gas, hydrogen gas and ammonia gas was introduced thereinto for carrying out glow-discharging decomposition to thereby form a first surface layer having a thickness of about 0.05 μm over the electron trapping layer. The filming conditions were as follows:

100% silane gas flow rate: 26 $cm^3$/min
100% hydrogen gas flow rate: 180 $cm^3$/min
100% ammonia gas flow rate: 30 $cm^3$/min
Inner pressure of reactor: 0.5 Torr
Discharging power: 50 W
Discharging time: 6 min After formation of the first surface layer, a mixture comprising silane gas, hydrogen gas and ammonia gas was introduced thereinto for carrying out glow-discharging decomposition to thereby form a second surface layer having a thickness of about 0.1 μm over the first surface layer. The filming conditions were as follows:

100% silane gas flow rate: 24 $cm^3$/min
100% hydrogen gas flow rate: 180 $cm^3$/min
100% ammonia gas flow rate: 36 $cm^3$/min
Inner pressure of reactor: 0.5 Torr
Discharging power: 50 W
Discharging time: 40 min After formation of the second surface layer, a mixture comprising silane gas, hydrogen gas and ammonia gas was introduced thereinto for carrying out glow-discharging decomposition to thereby form a third surface layer having a thickness of about 0.1 μm over the second surface layer. The filming conditions were as follows:

100% silane gas flow rate: 15 $cm^3$/min
100% hydrogen gas flow rate: 180 $cm^3$/min
100% ammonia gas flow rate: 43 $cm^3$/min
Inner pressure of reactor: 0.5 Torr
Discharging power: 50 W
Discharging time: 20 min As a developing agent, used was an electroconductive magnetic one-component capsule toner as prepared by encapsulating a core component comprising lauryl methacrylate polymer, a magnetic powder and a solvent with a polyurea resin. The respective capsules have a grain size of 15 μm, and copying operation was carried out. Precisely, the charging voltage of the photoreceptor was adjusted to be 300 V by the charging device, and the potential to the developing device was 300 V. The timing of charging and development bias was synchronized with the conveyance speed of conveying transfer papers. As the exposing means, used was an LED for exposing the image area.

As the discharging device 9, used was a system comprising light-discharging followed by corotron discharging. The polarity of the current as applied to the corotron was opposite to the charging potential polarity of the photoreceptor. A steel blade was used as the cleaning device 8 for the photoreceptor.

Pressure of 200 kg weight/$cm^2$ was applied between the transferring pressure roll and the photoreceptor, and 1000 sheets were copied continuously. During the continuous copying operation, the sheet pathway did not clog with the sheets. Observing the transferring pressure roll after the operation, no toner was noted to adhere thereto. Observing the back surface of the copies obtained, no toner was noted to adhere thereto. Observing the blade as applied to the transferring pressure roll, no toner was noted to adhere thereto.

The copying operation was further continued to obtain 100,000 copies, whereupon the surface of the photoreceptor was not scratched by the cleaning device and the copied images were free from faults of black streaks. After 1,000,000 copies were further obtained by the continuous copying operation, the surface of the photoreceptor was scratched by the blade for the first time and black streaks were printed out in the copies.

COMPARATIVE EXAMPLE 1

The same electrophotographic apparatus as that used in Example 1 was used, except that an electric discharger not equipped with corotron was used in place of the discharging device 9 and that the blade 10 was not applied to the transferring pressure roll, to carry out the same copying operation as that in Example 1. As a result, after 10 copies, the sheets clogged the sheet pathway in the apparatus. Observing the transferring pressure roll when the sheet pathway was clogged with the sheets, the toner was noted to adhere to the roll. Observing the back surface of the copies obtained, the toner was noted to adhere thereto.

EXAMPLE 2

An electrophotographic photoreceptor was formed in the same manner as in Example 1, except that the filming time of filming the third surface layer was prolonged 10 times so that the thickness of the third surface layer was 1 μm. Using this, the same continuous copying operation as that in Example 1 was carried out to obtain 1000 copies. The paper pathway did not clog with the sheets during the copying operation. Observing the transferring pressure roll after the operation, no toner was noted to adhere thereto. Observing the back surface of the copies obtained, no toner was noted to adhere thereto. Observing the blade as applied to the transferring pressure roll, no toner was noted to adhere thereto.

The copying operation was further continued to obtain 1,000,000 copies, whereupon the surface of the photoreceptor was not scratched by the cleaning device and the copied images were free from faults of black streaks.

COMPARATIVE EXAMPLE 2

The same electrophotographic apparatus as that used in Example 2 was used, except that an electric discharger not equipped with corotron was used in place of the discharging device 9 and that the blade 10 was not applied to the transferring pressure roll, to carry out the same copying operation as that in Example 2. As a result, after 10 copies, the sheets clogged the sheet pathway in the apparatus. Observing the transferring pressure roll when the sheet pathway was clogged with the sheets, the toner was noted to adhere to the roll. Observing the back surface of the copies obtained, the toner was noted to adhere thereto.

COMPARATIVE EXAMPLE 3

The same electrophotographic apparatus as that used in Example 2 was used, except that an electric discharger not equipped with corotron was used in place of the discharging device 9, to carry out the same copying operation as that in Example 2. After 1000 copies, the sheet pathway did not clog with the sheets. Observing the transferring pressure roll after the operation, no toner was noted to adhere thereto. Observing the back surface of the copies obtained, no toner was noted to adhere thereto. However, observing the blade as applied to the transferring fixing pressure roll, the toner was noted to adhere to the blade. Observing the printed copies, increase of the fog was noted with increase of the number of the printed copies. The charging potential of the photoreceptor as measured during the continuous copying operation was noted to increase with increase of the number of the printed copies.

EXAMPLE 3

An electrophotographic photoreceptor was formed in the same manner as in Example 1, except providing a fourth surface layer over a third surface layer.

The filming conditions of forming the fourth surface layer were as follows:

| | |
|---|---|
| Silicone for protective coating (X-41-9710H; product by Shin-etsu Chemical Co.) | 50 parts by weight |
| Electroconductive Powder of Tin oxide/ Antimony oxide (15%) | 9 parts by weight |

The preceding components were mixed and milled at 10° C. for 50 hours and the resulting dispersion was coated over the third layer by spray-coating and dried at 180° C. for one hour to form thereon a fourth surface layer having a thickness of 1 μm.

In the electrophotographic apparatus of FIG. 1, the pressure transferring fixing device was composed of a transferring fixing pressure roll 5 made of a polyacetal as coated with a surface protecting layer of a silicone hard coat film and a cleaning mechanism 10 of a stainless steel blade as applied to the roll.

As the developing agent used for copying operation, used was an electroconductive capsule type one-component toner containing a core component comprising lauryl methacrylate polymer (LMA), a magnetic powder and a solvent, the core component being encapsulated with a polyurea resin. The toner had a grain size of 15 μm. Precisely, the charging voltage of the photoreceptor was adjusted to be 200 V by the charging device, and the potential to the developing device was 200 V. LED was used as the exposing device, with which the image area was exposed. Pressure of 200 kg weight/cm$^2$ was applied between the transferring fixing pressure roll and the photoreceptor, and 1000 sheets were copied continuously. During the continuous copying operation, the sheet pathway did not clog with the sheets. Observing the transferring fixing pressure roll after the operation, no toner was noted to adhere thereto. Observing the back surface of the copies obtained, no toner was noted to adhere thereto. Observing the blade as applied to the transferring fixing pressure roll, no toner was noted to adhere thereto.

COMPARATIVE EXAMPLE 4

The same electrophotographic apparatus as that in the previous Example 3 was used, except that the pressure transferring fixing device was not equipped with the stainless steel blade, to carry out the same copying operation as that in Example 3. As a result, after 10 copies, the sheets clogged the sheet pathway in the apparatus. Observing the transferring fixing pressure roll when the sheet pathway was clogged with the sheets, the toner was noted to adhere to the roll. Observing the back surface of the copies obtained, the toner was noted to adhere thereto.

As mentioned above, since-the electrophotographic apparatus of the present invention has an amorphous silicon photoreceptor and a transferring and fixing device equipped with a cleaning mechanism, simultaneous transference and fixation of the toner image as formed on the photoreceptor onto a transfer paper under pressure may well be effected with removing the toner as remaining on the surface of the transferring part, such as a transferring fixing pressure roll, of pressing the photoreceptor. Therefore, the apparatus of the present invention is free from troubles of clogging of transfer papers or of staining of the back surface of transferred papers, which are caused by the toner as adhered to the surface of the transferring part. Accordingly, the apparatus of the invention is an energy-saving and cost-saving one and may yield copy images with high reliability.

In addition, the electrophotographic apparatus of the present invention has another advantage that an electroconductive magnetic one-component toner and an electroconductive magnetic one-component capsule toner, which could not be used in an electrostatic transfer system, may be used.

Further, since the electrophotographic process of the present invention uses an amorphous silicon photoreceptor and uses an electric charger or a discharging brush or blade as the discharging device, transference or simultaneous transference and fixation of the toner image as formed on the photoreceptor onto a transfer paper under pressure may well be effected without adhesion of the toner being used to the surface of the transferring part, such as a transferring pressure roll, which presses the photoreceptor. Therefore, the method of the present invention is free from troubles of clogging of transfer papers or of staining of the back surface of transferred papers, which are caused by the toner as adhered to the surface of the transferring part. Accordingly, the method of the invention is an energy-saving and cost-saving one and may yield copy images with high reliability.

In addition, the electrophotographic method of the present invention has another advantage that an electroconductive one-component toner, such as an electroconductive magnetic one-component capsule toner, which could not be used in an electrostatic transfer system, may be used.

What is claimed is:

1. A method of copying an image onto a transfer paper with an electrophotographic apparatus including a photoreceptor comprising a metallic cylindrical support having thereon, an inhibiting layer, a photoconductive layer on the inhibiting layer, an electron trapping layer on the photoconductive layer, a photosensitive layer made of amorphous silicon on the electron trapping layer, and a surface protecting layer on the photosensitive layer, said method comprising the steps of:

uniformly heating the photosensitive layer and the surface protecting layer of the photoreceptor to a constant temperature;

forming an electrostatic latent image on the photoreceptor;

developing the electrostatic latent image with a developing agent to form a toner image on the photoreceptor;

applying pressure of 100 kg weight/cm$^2$ or more on the transfer paper while the transfer paper is laid over the toner image on the photoreceptor such that the transfer paper is pressed against the surface protecting layer of the photoreceptor and the pressure is opposed by the cylindrical support to simultaneously transfer and fix the toner image onto the transfer paper; and removing charges from the photoreceptor using one of a charging device, discharging brush, and discharging blade.

2. The method as claimed in claim 1, wherein the charging device comprises one of a scorotron, a dicorotron and a charging roll.

3. The method as claimed in claim 1, further including the step of:

pre-discharging the photoreceptor by irradiating light onto the photoreceptor prior to removing charges from the photoreceptor.

4. The method as claimed in claim 1, wherein the transfer of the toner image is effected by applying pressure to the transfer paper and heating the photoreceptor.

5. The method as claimed in claim 1, in which a capsule toner is used as the developing agent.

6. The method as claimed in claim 1, in which an electroconductive magnetic one-component toner is used as the developing agent.

7. The method as claimed in claim 1, in which a pressure transferring roll is used to impart pressure to the photoreceptor and the transfer paper.

8. An electrophotographic apparatus for copying an original image onto a transfer paper comprising:

a photoreceptor comprising a metallic cylindrical support having thereon, an inhibiting layer, a photoconductive layer on the inhibiting layer, an electron trapping layer on the photoconductive layer, a photosensitive layer made of amorphous silicon on the electron trapping layer, and a surface protecting layer on the photosensitive layer;

a heater for uniformly heating the photosensitive layer and the surface protecting layer of the photoreceptor to a constant temperature;

a charging device for creating a charge on the photoreceptor;

an exposing device for exposing a light passed through the original image to form an electrostatic latent image on the photoreceptor;

a developing device for developing the electrostatic latent image with a developing agent to form a toner image on the photoreceptor; and a transferring/fixing device for simultaneously transferring and fixing the toner image onto the transfer paper by applying pressure of 100 kg weight/cm$^2$ or more on the transfer paper while the transfer paper is laid over the toner image on the photoreceptor, wherein the transferring/fixing device includes a transferring part for pressing the transfer paper between the photoreceptor and said transferring part, and a cleaning mechanism for cleaning an outer surface of the transferring part.

9. The electrophotographic apparatus as claimed in claim 8, in which the transferring part is a pressure roll.

10. The electrophotographic apparatus as claimed in claim 9, in which the pressure roll has a surface protecting layer.

11. The electrophotographic apparatus as claimed in claim 10, in which the surface protecting layer of the pressure roll is made of at least one selected from the group consisting of ceramics, metals, organic high polymer substances and inorganic high polymer substances.

12. The electrophotographic apparatus as claimed in claim 9, in which the pressure roll has a surface hardness durable to 100 kg weight/cm$^2$.

13. The electrophotographic apparatus as claimed in claim 8, in which the cleaning mechanism is composed of at least one selected from a blade, a wiper and a brush roll.

14. An electrophotographic process using an electrophotographic apparatus including a photoreceptor, a heater, and a transferring part equipped with a cleaning mechanism, the photoreceptor comprising a metallic cylindrical support having thereon, an inhibiting layer, a photoconductive layer on the inhibiting layer, an electron trapping layer provided on the photoconductive layer, a photosensitive layer made of amorphous silicon on the electron trapping layer, and a surface protecting layer on the photosensitive layer, said process comprising the steps of:

uniformly heating the photosensitive layer and the surface protecting layer of the photoreceptor to a constant temperature with said heater;

placing a transfer paper over a toner image formed by electrophotography on the photoreceptor;

pressing the transfer paper and photoreceptor with a pressure of 100 kg weight/cm$^2$ or more using the transferring part such that the transfer paper is pressed between the cylinder supported photoreceptor and the transferring part to simultaneously transfer and fix the toner image onto the transfer paper; and cleaning the transferring part using the cleaning mechanism.

15. The electrophotographic process as claimed in claim 14, in which the toner image is formed with a developing agent comprising a capsule toner.

16. The electrophotographic process as claimed in claim 14, in which the toner image is formed with an electroconductive magnetic one-component developing agent.

17. The electrophotographic process as claimed in claim 14, in which the toner image is formed with a developing agent of an electroconductive magnetic one-component capsule toner.

18. The electrophotographic process as claimed in claim 14, in which the simultaneous transference and fixation is conducted by applying a pressure with the transferring part to the photoreceptor while the photoreceptor is being heated.

* * * * *